US011555322B1

(12) United States Patent
Curtice

(10) Patent No.: US 11,555,322 B1
(45) Date of Patent: Jan. 17, 2023

(54) POOL CHEMICAL INJECTOR AND METHOD OF USE

(71) Applicant: Steven M. Curtice, Houston, TX (US)

(72) Inventor: Steven M. Curtice, Houston, TX (US)

( * ) Notice: Subject to any disclaimer, the term of this patent is extended or adjusted under 35 U.S.C. 154(b) by 135 days.

(21) Appl. No.: 16/431,160

(22) Filed: Jun. 4, 2019

Related U.S. Application Data

(60) Provisional application No. 62/680,243, filed on Jun. 4, 2018.

(51) Int. Cl.

| | |
|---|---|
| ***E04H 4/16*** | (2006.01) |
| ***B05C 17/005*** | (2006.01) |
| ***B08B 3/08*** | (2006.01) |
| ***B08B 3/02*** | (2006.01) |

(52) U.S. Cl.
CPC ..... *E04H 4/16* (2013.01); *B05C 17/00503* (2013.01); *B08B 3/026* (2013.01); *B08B 3/08* (2013.01)

(58) Field of Classification Search
None
See application file for complete search history.

(56) References Cited

U.S. PATENT DOCUMENTS 2,069,673 A * 2/1937 Lima ..... A47L 13/30 222/510
2,904,812 A * 9/1959 Lee ..... A47L 13/312 401/206
3,080,590 A * 3/1963 Mullinix ..... A47L 13/22 15/1.7
4,009,049 A * 2/1977 Pansini ..... E04H 4/16 134/21
4,291,491 A * 9/1981 Maddock ..... A01M 21/043 401/140
4,966,481 A * 10/1990 Satten ..... B05C 17/002 222/481.5
5,735,620 A * 4/1998 Ford ..... A46B 5/0075 401/24
5,957,606 A * 9/1999 Jafarmadar ..... E04F 21/1652 401/137
2001/0053305 A1* 12/2001 Berke ..... A45D 34/04 401/6
2005/0191116 A1* 9/2005 Flanery ..... A47L 13/22 401/272

FOREIGN PATENT DOCUMENTS

EP 0182667 A2 * 5/1986 ..... A01G 25/145

* cited by examiner

*Primary Examiner* — Eric W Golightly
*Assistant Examiner* — Arlyn I Rivera-Cordero
(74) *Attorney, Agent, or Firm* — Leavitt Eldredge Law Firm

(57) ABSTRACT

A pool chemical injector includes a chamber to hold a volume of a chemical therein, the chamber having a body with a tapered end; an opening to allow for insertion of the chemical into the chamber; an elongated tube to attach to the tapered end of the body; a valve engaged with the tube and to open and close chemical flow through the elongated tube; and an attachment to secure to an end of the elongated tube through which the chemical flows; the elongated tube and attachment deliver the chemical to a floor of the pool.

4 Claims, 3 Drawing Sheets

POOL CHEMICAL INJECTOR AND METHOD OF USE

BACKGROUND

1. Field of the Invention

The present invention relates generally to pool chemical treatment systems and methods and more specifically, to a pool chemical injector having an easy to use chamber and valve configuration to allow for injection of chemicals at the bottom of the pool, thereby preventing the chemical from becoming watered down.

2. Description of Related Art

Pool chemical treatment systems are well known in the art for the treatment of stains on the bottom surface of a pool. Stains can develop when an item is left in the pool and rusts, or from a variety of other causes. Currently, the conventional method is shown in flowchart 101, wherein the stain develops and the user proceeds to pour a chemical, such as an acid based chemical well known in the pool maintenance industry, into the pool, as shown with box 103, 105. The chemical is heavier than water and sinks to a bottom of the pool, wherein the chemical becomes watered down in the process, as shown with boxes 107, 109.

One of the problems commonly associated with method 101 is the watering down of the chemical. This forces the user to increase the amount of chemical used, thereby being inefficient.

Accordingly, although great strides have been made in the area of chemical injection systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
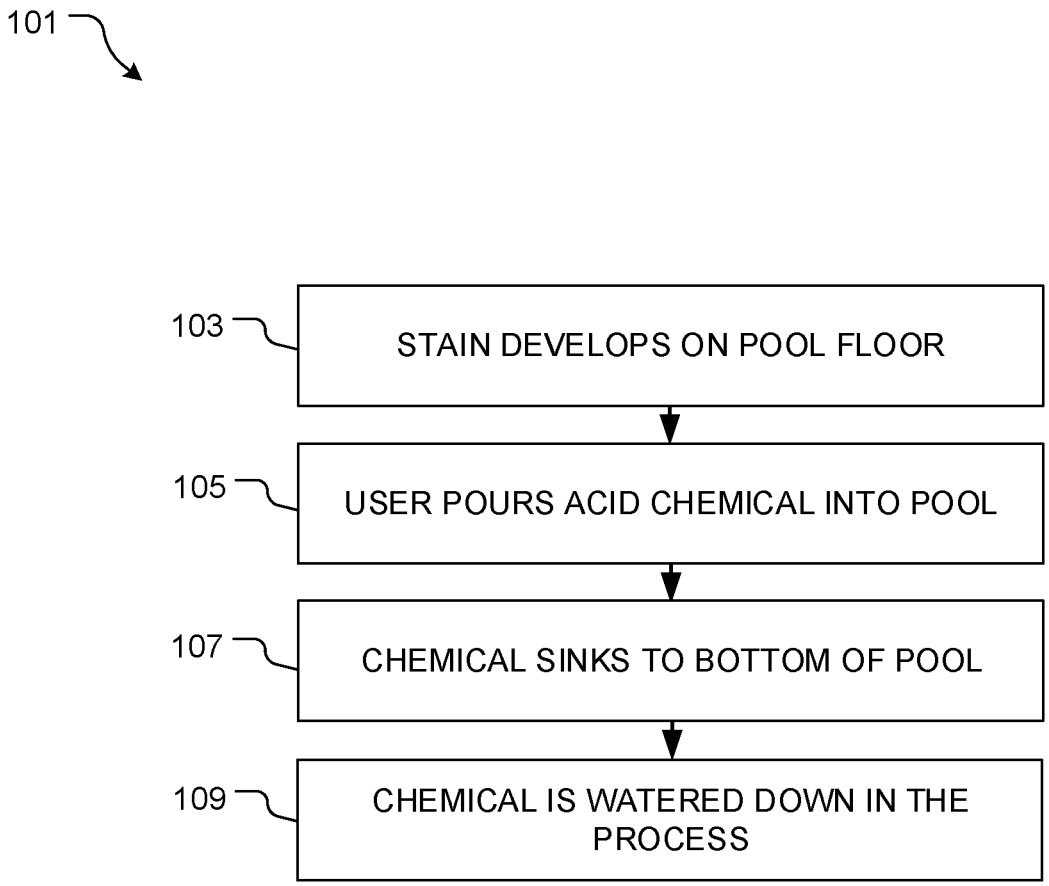
FIG. 1 (Prior Art)
FIG. 1 is a flowchart of a conventional chemical treatment system.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional chemical treatment systems. Specifically, the present invention provides a pool chemical injector that is simple and efficient to use to inject chemical directly to a stain, thereby preventing the chemical from becoming watered down. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
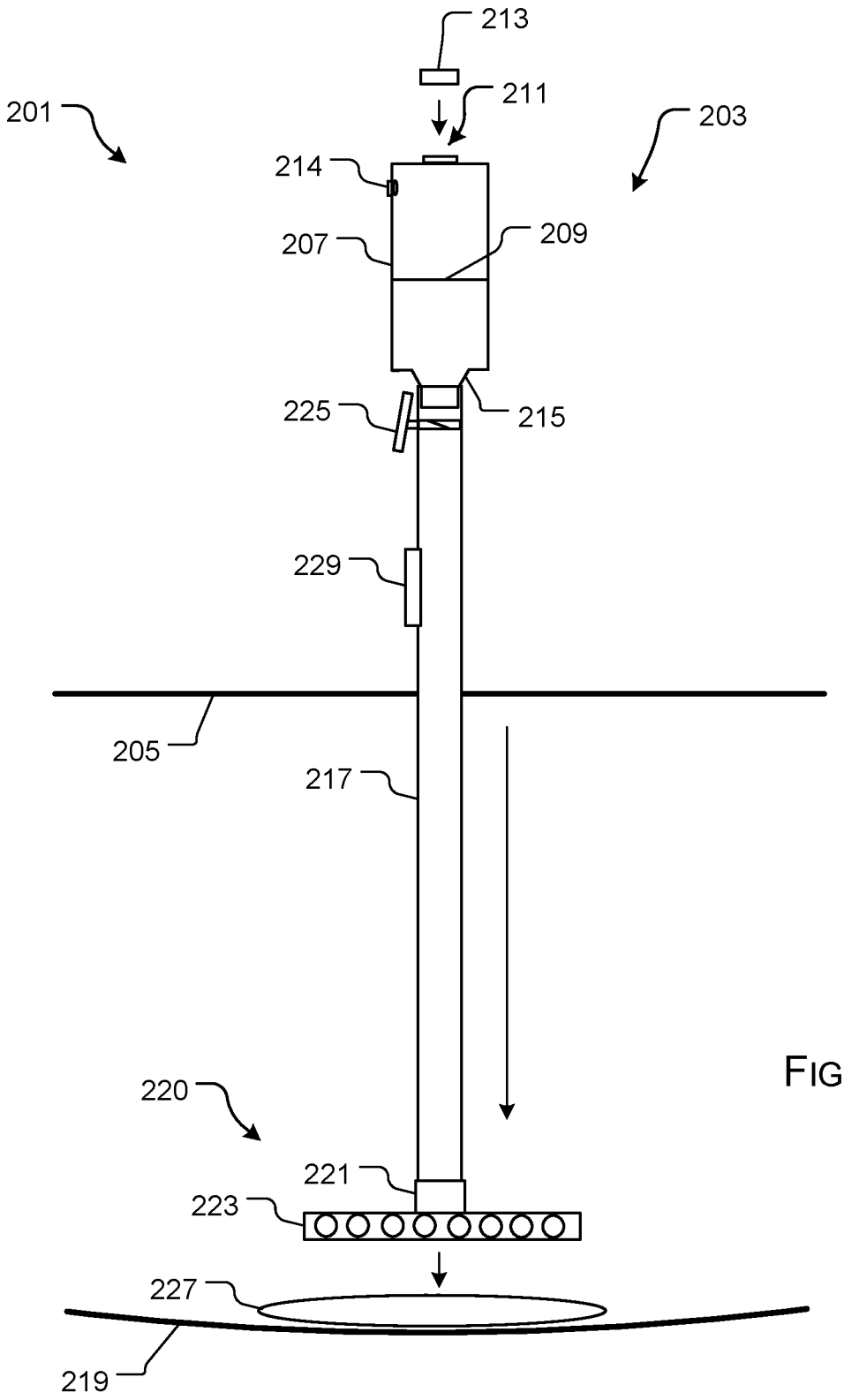
FIG. 2 is a front view of a simplified schematic of a pool chemical injection system in accordance with a preferred embodiment of the present application.

Referring now to the drawings wherein like reference characters identify corresponding or similar elements throughout the several views, FIG. 2 depicts a front view of a pool chemical injector system 201 in accordance with a preferred embodiment of the present application. It will be appreciated that system 201 overcomes one or more of the above-listed problems commonly associated with conventional chemical treatment systems.

In the contemplated embodiment, system 201 includes a pool chemical injector 203 configured to be inserted into a pool 205. The injector 203 includes a chamber 207 configured to receive and hold a chemical 209 therein, the chamber 207 being filled via an opening 211 with a cap 213. It should be appreciated that the chamber 207 can vary in size and materials as desired. Further, it should be appreciated that cap 213 can be a threaded cap to screw over the opening 211, or any other cap known in the art. The chamber 207 can further include one or more bleed holes 214.

In some embodiments, the chamber 207 includes a tapered end 215 configured to secure to a first end of a tube 217, the tube 217 being elongated to extend toward a floor 219 of the pool. Tube 217 is further configured to engage with an attachment 220, the attachment 220 being removably secured via a connection 221 and further having a body 223 extending perpendicular to the connection. It must be appreciated that various forms of attachments could be used.

In the preferred embodiment, a valve 225 is positioned to open and close the tube 217, thereby allowing for the chemical 209 to be injected to attachment 220 and be injected directly over a stain 227. Further, it should be appreciated that some embodiments can include a handle 229 attached to tube 217 to allow for easier maneuverability.

It should be appreciated that one of the unique features believed characteristic of the present application is the orientation of components, including the chamber being connected to a tube that extends to an attachment. This configuration allows for the user to easily inject a chemical, via the valve, directly to a floor of the pool, thereby preventing the chemical from becoming watered down.

Figure 3:
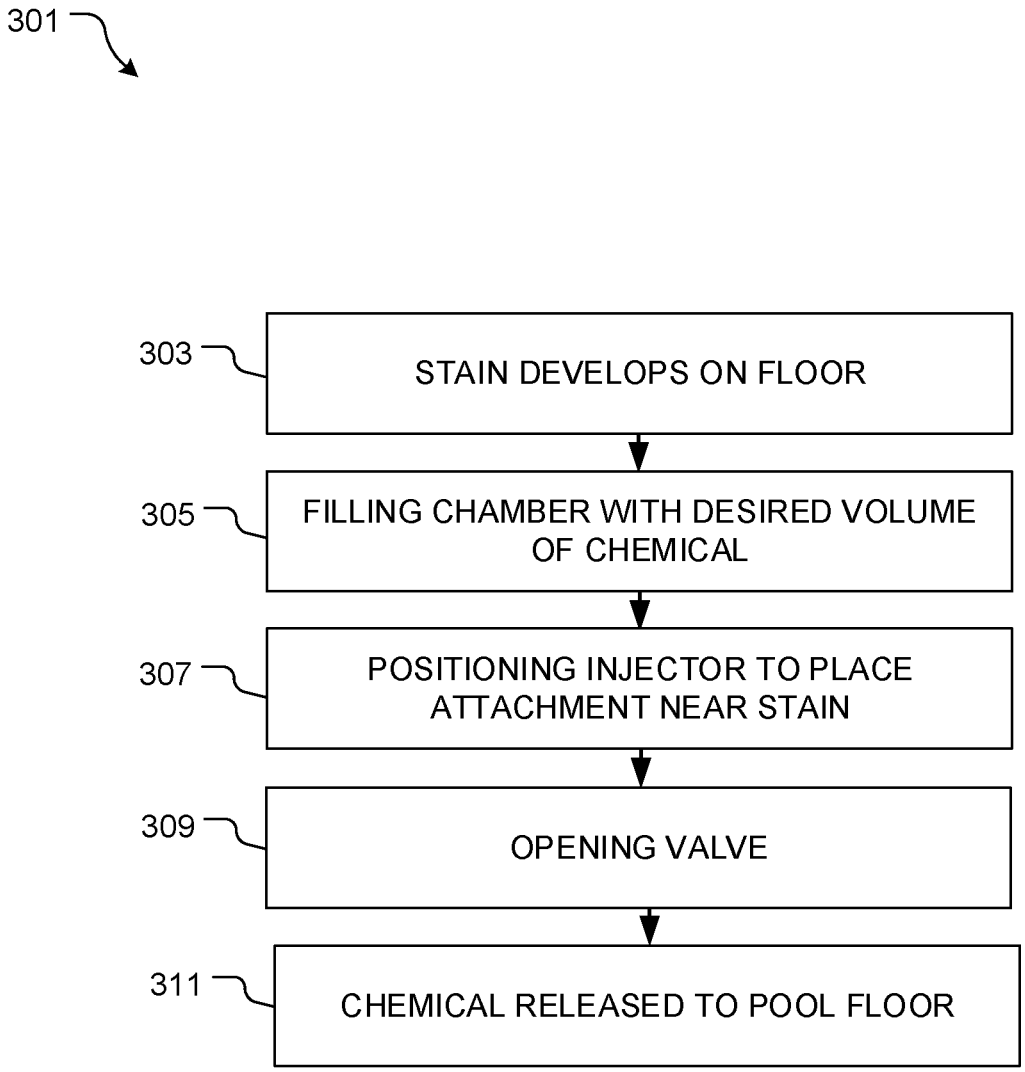
FIG. 3 is a flowchart of the method of use of the system of FIG. 2.

In FIG. 3, a flowchart 301 further depicts the method of use of system 201. During use, after a stain develops the user proceeds to inject a chemical with the injector, as shown with box 303. The user fills the chamber with a desired amount of the chemical and inserts the tube into the pool, as shown with boxes 305, 307. The user then opens the valve, wherein the chemical travels through the tube and attachment to the pool floor, as shown with boxes 309, 311.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A pool chemical injector system, comprising:

a pool; and a pool chemical injector, having:

a chamber configured to hold a volume of a chemical therein, the chamber having:

a body extending from a first end to a second end, the second end having a tapered end while the first end having an opening in fluid communication with a cavity formed by the body, the first end is opposite of the second end; and a bleed hole extending in fluid communication with the cavity, the bleed hole is positioned adjacent to the opening and extending from a side of the body, the side being perpendicular to the first end and the second end;

a cap removably engaged with the opening;

an elongated tube extending from a top end to a bottom end and attached to the tapered end of the body, the tapered end of the body extending into the top end of the elongated tube;

a valve engaged with the tube, the valve having a handle positioned on an exterior of the tube, the handle attached to a protrusion that extends into the interior of the tube and across an entire diameter of the tube, the valve is configured to open and close chemical flow through the elongated tube through operation of the handle, the valve is positioned near the tapered end of the body; and an attachment secured to an end of the elongated tube at the bottom end of the elongated tube, the attachment extends perpendicular to the elongated tube and is configured to receive chemical flows from the elongated tube;

wherein the elongated tube and attachment deliver the chemical to a floor of the pool.

2. A pool chemical injector, comprising:

a chamber configured to hold a volume of a chemical therein, the chamber having:

a body extending from a first end to a second end, the second end having a tapered end while the first end having an opening in fluid communication with a cavity formed by the body, the first end is opposite of the second end; and a bleed hole extending in fluid communication with the cavity, the bleed hole is positioned adjacent to the opening and extending from a side of the body, the side being perpendicular to the first end and the second end;

a cap removably engaged with the opening;

an elongated tube extending from a top end to a bottom end and attached to the tapered end of the body, the tapered end of the body extending into the top end of the elongated tube;

a valve engaged with the tube, the valve having a handle positioned on an exterior of the tube, the handle attached to a protrusion that extends into the interior of the tube and across an entire diameter of the tube, the valve is configured to open and close chemical flow through the elongated tube through operation of the handle, the valve is positioned near the tapered end of the body; and an attachment secured to an end of the elongated tube at the bottom end of the elongated tube, the attachment extends perpendicular to the elongated tube and is configured to receive chemical flows from the elongated tube;

wherein the elongated tube and attachment deliver the chemical to a floor of the pool.

3. The pool chemical injector of claim 2, further comprising:

a handle attached to the elongated tube.

4. The pool chemical injector of claim 2, wherein the attachment further comprises:

a connection configured to removably secure to the elongated tube; and a body extending out perpendicular to the connection and configured to disperse the chemical.

* * * * *